US009146508B2

(12) United States Patent
Imada et al.

(10) Patent No.: US 9,146,508 B2
(45) Date of Patent: Sep. 29, 2015

(54) FIXING DEVICE, IMAGE FORMING APPARATUS, AND FIXING METHOD

(71) Applicants: Takahiro Imada, Kanagawa (JP); Masaaki Yoshikawa, Tokyo (JP); Takayuki Seki, Kanagawa (JP); Yuji Arai, Kanagawa (JP); Takeshi Yamamoto, Kanagawa (JP); Ryuuichi Mimbu, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP)

(72) Inventors: Takahiro Imada, Kanagawa (JP); Masaaki Yoshikawa, Tokyo (JP); Takayuki Seki, Kanagawa (JP); Yuji Arai, Kanagawa (JP); Takeshi Yamamoto, Kanagawa (JP); Ryuuichi Mimbu, Kanagawa (JP); Yutaka Ikebuchi, Kanagawa (JP); Takuya Seshita, Kanagawa (JP); Shuntaro Tamaki, Kanagawa (JP); Hajime Gotoh, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/268,198

(22) Filed: May 2, 2014

(65) Prior Publication Data

US 2014/0341625 A1 Nov. 20, 2014

(30) Foreign Application Priority Data

May 15, 2013 (JP) ..... 2013-102676

(51) Int. Cl.
*G03G 15/20* (2006.01)

(52) U.S. Cl.
CPC ..... *G03G 15/2017* (2013.01); *G03G 15/2042* (2013.01); *G03G 2215/2016* (2013.01); *G03G 2215/2035* (2013.01)

(58) Field of Classification Search
CPC ..... G03G 15/2017; G03G 15/2042; G03G 2215/2035; G03G 2215/2016
USPC ..... 399/329, 69, 334
See application file for complete search history.

(56) References Cited

U.S. PATENT DOCUMENTS 7,657,217 B2 * 2/2010 Wakahara et al. ..... 399/330
2007/0292175 A1 12/2007 Shinshi (Continued)

FOREIGN PATENT DOCUMENTS

JP 4-44083 2/1992
JP 2004-286922 10/2004

(Continued)

OTHER PUBLICATIONS

U.S. Appl. No. 14/267,097, filed May 1, 2014.

(Continued)

*Primary Examiner* — Rodney Bonnette
(74) *Attorney, Agent, or Firm* — Oblon, McClelland, Maier & Neustadt, L.L.P.

(57) ABSTRACT

A fixing device includes a fixing rotator heated by a heater and a pressing rotator pressed against the fixing rotator to form a fixing nip therebetween, through which a recording medium bearing a toner image is conveyed. A heat shield interposed between the heater and the fixing rotator is movable in a circumferential direction of the fixing rotator to shield the fixing rotator from the heater in a variable axial shield span of the fixing rotator. The fixing rotator performs fixing rotation to convey the recording medium through the fixing nip while heating the recording medium and supplemental rotation other than fixing rotation. The heat shield moves to a decreased shield span position where the heat shield shields the fixing rotator from the heater in a decreased axial shield span of the fixing rotator during supplemental rotation thereof.

11 Claims, 9 Drawing Sheets

(56) References Cited

U.S. PATENT DOCUMENTS

| | | | | |
|---|---|---|---|---|
| 2010/0067929 | A1 | 3/2010 | Seki | |
| 2013/0209147 | A1 | 8/2013 | Ogawa et al. | |
| 2014/0072355 | A1* | 3/2014 | Tamaki et al. | 399/329 |
| 2014/0079424 | A1* | 3/2014 | Ikebuchi et al. | 399/69 |
| 2014/0079453 | A1* | 3/2014 | Arai et al. | 399/329 |
| 2014/0079455 | A1* | 3/2014 | Seki et al. | 399/329 |
| 2014/0248072 | A1* | 9/2014 | Yoshinaga et al. | 399/329 |
| 2014/0270820 | A1* | 9/2014 | Saito et al. | 399/33 |
| 2014/0270822 | A1* | 9/2014 | Yamashina et al. | 399/45 |
| 2014/0270831 | A1* | 9/2014 | Yoshinaga et al. | 399/67 |
| 2014/0270832 | A1* | 9/2014 | Saito et al. | 399/67 |
| 2014/0270833 | A1* | 9/2014 | Yuasa et al. | 399/67 |
| 2014/0270872 | A1* | 9/2014 | Tamaki et al. | 399/329 |
| 2014/0270875 | A1* | 9/2014 | Mimbu et al. | 399/329 |
| 2014/0341623 | A1* | 11/2014 | Arai et al. | 399/329 |
| 2014/0341624 | A1 | 11/2014 | Arai et al. | |

FOREIGN PATENT DOCUMENTS

| | | |
|---|---|---|
| JP | 2007-334205 | 12/2007 |
| JP | 2010-066583 | 3/2010 |
| JP | 2012-048131 | 3/2012 |

OTHER PUBLICATIONS

U.S. Appl. No. 14/267,169, filed May 1, 2014.

* cited by examiner

FIXING DEVICE, IMAGE FORMING APPARATUS, AND FIXING METHOD

CROSS-REFERENCE TO RELATED APPLICATION

This patent application is based on and claims priority pursuant to 35 U.S.C. §119 to Japanese Patent Application No. 2013-102676, filed on May 15, 2013, in the Japanese Patent Office, the entire disclosure of which is hereby incorporated by reference herein.

BACKGROUND

1. Technical Field

Exemplary aspects of the present invention relate to a fixing device, an image forming apparatus, and a fixing method, and more particularly, to a fixing device for fixing an image on a recording medium, an image forming apparatus incorporating the fixing device, and a fixing method for fixing a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may employ an endless belt or an endless film to heat the recording medium. For example, the fixing device may include an endless belt and a pressure roller pressed against the belt to form a fixing nip therebetween. As a recording medium bearing a toner image is conveyed through the fixing nip, the belt and the pressure roller apply heat and pressure to the recording medium, melting and fixing the toner image on the recording medium.

The belt is requested to be heated quickly to shorten a first print time taken to output the recording medium bearing the fixed toner image upon receipt of a print job. Additionally, as the image forming apparatus conveys an increased amount of recording media at high speed, the belt is requested to overcome shortage of heat.

In order to shorten the first print time, the fixing device may include an endless film and a pressure roller pressed against a ceramic heater disposed inside the film to form a fixing nip between the film and the pressure roller. As a recording medium bearing a toner image is conveyed through the fixing nip, the film heated by the ceramic heater and the pressure roller fix the toner image on the recording medium under heat and pressure. Since the film is heated by the heater situated at the fixing nip, the film is heated insufficiently at an entry to the fixing nip, resulting in faulty fixing. Accordingly, the film is requested to overcome shortage of heat at the entry to the fixing nip.

To address those requests, the fixing device may employ a tubular, metal thermal conductor disposed inside the belt. The pressure roller is pressed against the metal thermal conductor via the belt to form a fixing nip between the belt and the pressure roller. A heater situated inside the metal thermal conductor heats the metal thermal conductor which in turn heats the belt. As a recording medium bearing a toner image is conveyed through the fixing nip, the belt heated by the metal thermal conductor and the pressure roller apply heat and pressure to the recording medium, fixing the toner image on the recording medium. Since the tubular, metal thermal conductor is disposed opposite the belt throughout the entire circumferential span thereof, the metal thermal conductor heats the belt quickly, thus shortening the first print time and overcoming shortage of heat.

In order to shorten the first print time and save energy further, the belt heated by the heater directly, not through the metal thermal conductor, is proposed. For example, a heater disposed inside the belt heats the belt directly. A shield plate is interposed between the heater and the belt to shield the belt from the heater. A controller moves the shield plate based on the size of the recording medium to change a direct heating area where the heater heats the belt directly. The shield plate includes a slot through which the heater irradiates the belt directly and a shield portion that shields the belt from the heater. The controller moves the shield portion to change the width of the slot, thus changing the direct heating area where the heater heats the belt directly.

As a fixing job finishes, the heater is turned off and therefore the belt stops heating the recording medium. However, residual heat is conducted from the heater to the shield plate. Since the belt stops rotation as the fixing job finishes, the heated shield plate may heat the belt locally, causing temperature variation of the belt in a circumferential direction thereof that may result in local plastic deformation of the belt such as kink. To address this problem, when the belt overheats locally, the belt may resume rotation to level residual heat conducted to the belt in the circumferential direction thereof so as to reduce temperature variation thereof.

However, even when the belt resumes rotation, the shield plate shielding the belt from the heater may be heated by residual heat from the heater, obstructing leveling of residual heat conducted to the belt. Additionally, when the shield plate is heated, the shield plate may halt at an inappropriate position where heat is not conducted from the shield plate to a peripheral component. Conversely, when the shield plate is cool, the shield plate may draw heat from belt locally, causing temperature variation of the belt in the circumferential direction thereof.

SUMMARY

This specification describes below an improved fixing device. In one exemplary embodiment, the fixing device includes a fixing rotator rotatable in a predetermined direction of rotation to fix a toner image on a recording medium under heat and a heater disposed opposite the fixing rotator to heat the fixing rotator. A pressing rotator is pressed against the fixing rotator to form a fixing nip therebetween, through which the recording medium bearing the toner image is conveyed. A heat shield is interposed between the heater and the fixing rotator and movable in a circumferential direction of the fixing rotator to shield the fixing rotator from the heater in a variable axial shield span of the fixing rotator. The fixing rotator performs fixing rotation to convey the recording medium through the fixing nip while heating the recording medium and supplemental rotation other than fixing rotation.

The heat shield moves to a decreased shield span position where the heat shield shields the fixing rotator from the heater in a decreased axial shield span of the fixing rotator during supplemental rotation thereof.

This specification further describes an improved image forming apparatus. In one exemplary embodiment, the image forming apparatus includes an image forming device to form a toner image and a fixing device to fix the toner image on a recording medium. The fixing device includes a fixing rotator rotatable in a predetermined direction of rotation to fix the toner image on the recording medium under heat and a heater disposed opposite the fixing rotator to heat the fixing rotator. A pressing rotator is pressed against the fixing rotator to form a fixing nip therebetween, through which the recording medium bearing the toner image is conveyed. A heat shield is interposed between the heater and the fixing rotator and movable in a circumferential direction of the fixing rotator to shield the fixing rotator from the heater in a variable axial shield span of the fixing rotator. The image forming apparatus further includes a controller operatively connected to the fixing rotator, the heater, and the heat shield. The controller controls the fixing rotator to perform fixing rotation to convey the recording medium through the fixing nip while heating the recording medium and supplemental rotation other than fixing rotation and controls the heat shield to move to a decreased shield span position where the heat shield shields the fixing rotator from the heater in a decreased axial shield span of the fixing rotator during supplemental rotation thereof.

This specification further describes an improved fixing method. In one exemplary embodiment, the fixing method includes receiving a fixing job; starting fixing rotation of a fixing rotator; turning on a heater to heat the fixing rotator; moving a heat shield to an increased shield span position where the heat shield shields the fixing rotator from the heater in an increased axial shield span of the fixing rotator; conveying a recording medium over the fixing rotator; turning off the heater; starting supplemental rotation of the fixing rotator; and moving the heat shield to a decreased shield span position where the heat shield shields the fixing rotator from the heater in a decreased axial shield span of the fixing rotator.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
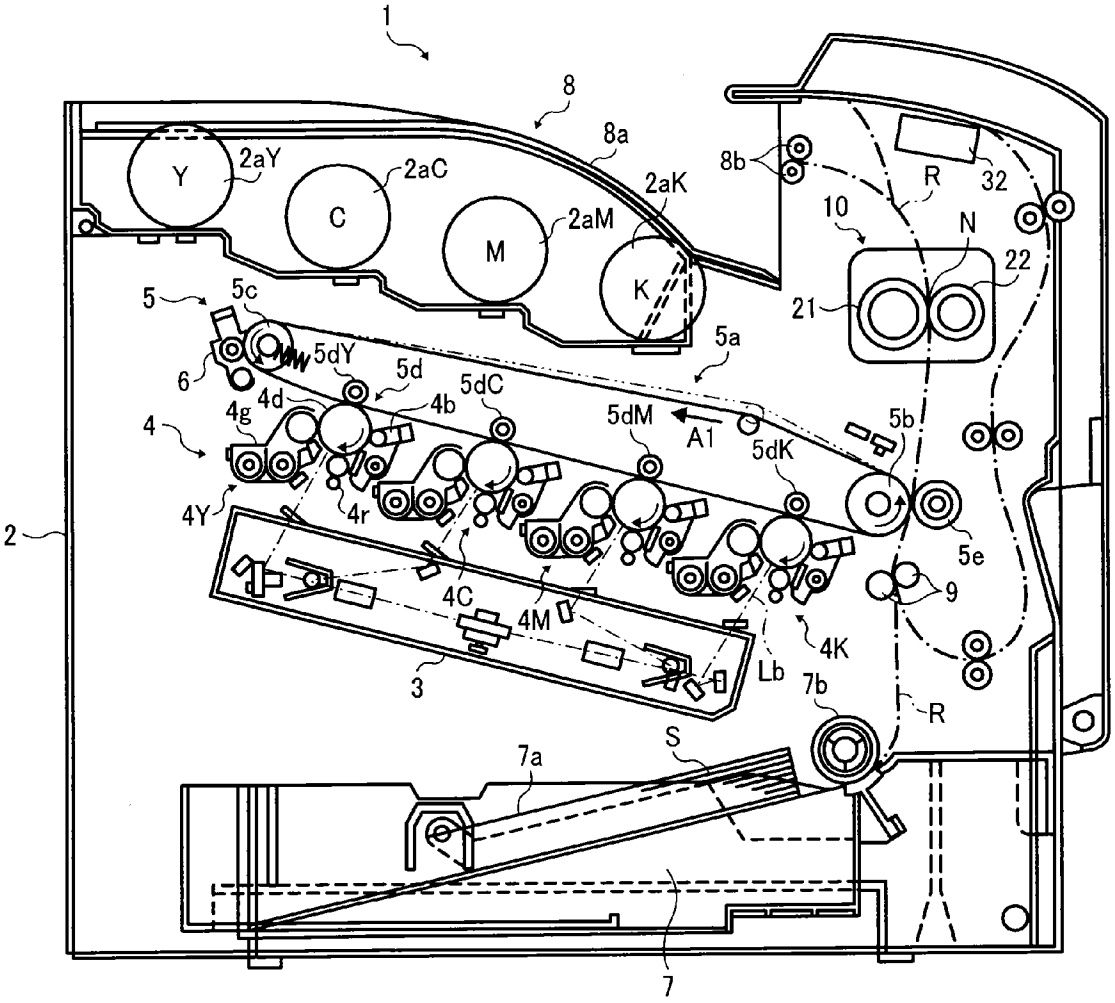
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on recording media by electrophotography.

As shown in FIG. 1, the image forming apparatus 1 includes a body 2 accommodating an optical writer 3, a process unit 4, a transfer device 5, a belt cleaner 6, a recording medium feeder 7, a registration roller pair 9, and a fixing device 10. The image forming apparatus 1 further includes an output device 8 disposed atop the body 2.

The image forming apparatus 1 has a tandem structure in which four photoconductive drums 4*d* serving as image carriers for bearing yellow, cyan, magenta, and black toner images are aligned in tandem. Alternatively, the image forming apparatus 1 may have a structure other than the tandem structure.

The body 2 is a cabinet accommodating various components. For example, the cabinet accommodates a conveyance path R through which a recording medium S (e.g., a sheet) is conveyed from the recording medium feeder 7 to the output device 8. Below the output device 8 are toner bottles 2*a*Y, 2*a*C, 2*a*M, and 2*a*K detachably attached to the body 2 and containing fresh yellow, cyan, magenta, and black toners, respectively. The body 2 further accommodates a waste toner container having an inlet in communication with a waste toner conveyance tube through which waste toner collected from the process unit 4 and the transfer device 5 is conveyed to the waste toner container.

A detailed description is now given of a construction of the optical writer 3.

The optical writer 3 includes a semiconductor laser serving as a light source, a coupling lens, an f-θ lens, a troidal lens, a deflection mirror, and a polygon mirror. The optical writer 3 emits a laser beam Lb onto the respective photoconductive drums 4*d* of the process unit 4 according to yellow, cyan, magenta, and black image data separated from color image data sent from an external device such as a client computer, forming electrostatic latent images on the photoconductive drums 4*d*, respectively.

A detailed description is now given of a construction of the process unit 4.

The process unit 4 includes four sub process units 4Y, 4C, 4M, and 4K serving as image forming devices that form yellow, cyan, magenta, and black toner images, respectively. Taking the sub process unit 4Y for forming a yellow toner image, for example, the sub process unit 4Y includes the photoconductive drum 4*d*, a charging roller 4*r*, a development device 4*g*, and a cleaning blade 4*b*. The charging roller 4*r*, the optical writer 3, the development device 4*g*, the transfer device 5, and the cleaning blade 4*b* surround the photoconductive drum 4*d* such that charging, optical writing, developing, transfer, cleaning, and discharging processes are performed on the photoconductive drum 4*d* in this order.

For example, the charging roller 4*r* charges an outer circumferential surface of the photoconductive drum 4*d* electrostatically. The optical writer 3 conducts optical writing on the charged outer circumferential surface of the photoconductive drum 4*d*, forming an electrostatic latent image formed of electrostatic patterns on the photoconductive drum 4*d*. The development device 4*g* adheres yellow toner supplied from the toner bottle 2*a*Y to the electrostatic latent image formed on the photoconductive drum 4*d*, thus visualizing the electrostatic latent image into a yellow toner image. The yellow toner image is primarily transferred onto the transfer device 5. The cleaning blade 4*b* removes residual toner failed to be transferred onto the transfer device 5 and therefore remaining on the photoconductive drum 4*d* therefrom, rendering the photoconductive drum 4*d* to be ready for a next primary transfer. Thereafter, the discharging process to remove residual static electricity from the photoconductive drum 4*d* is performed on the photoconductive drum 4*d*.

The photoconductive drum 4*d* is a tube including a surface photoconductive layer made of organic and inorganic photoconductors. The charging roller 4*r* is located in proximity to the photoconductive drum 4*d* to charge the photoconductive drum 4*d* with discharge between the charging roller 4*r* and the photoconductive drum 4*d*.

The development device 4*g* is constructed of a supply section for supplying yellow toner to the photoconductive drum 4*d* and a development section for adhering yellow toner to the photoconductive drum 4*d*. The cleaning blade 4*b* includes an elastic band made of rubber and a toner remover such as a brush. The development device 4*g* is detachably attached to the body 2.

Each of the sub process units 4C, 4M, and 4K has a construction equivalent to that of the sub process unit 4Y described above. The sub process units 4C, 4M, and 4K form cyan, magenta, and black toner images to be primarily transferred onto the transfer device 5, respectively.

A detailed description is now given of a construction of the transfer device 5.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt stretched taut across the driving roller 5*b* and the driven roller 5*c*. As the driving roller 5*b* rotating counterclockwise in FIG. 1 drives and rotates the transfer belt 5*a* in a rotation direction A1, the driven roller 5*c* is rotated counterclockwise in FIG. 1 by friction between the driven roller 5*c* and the transfer belt 5*a*.

The primary transfer rollers 5*d* include primary transfer rollers 5*d*Y, 5*d*C, 5*d*M, and 5*d*K pressed against the photoconductive drums 4*d* of the sub process units 4Y, 4C, 4M, and 4K via the transfer belt 5*a*, respectively. Thus, the transfer belt 5*a* contacts the sub process units 4Y, 4C, 4M, and 4K, forming four primary transfer nips between the transfer belt 5*a* and the sub process units 4Y, 4C, 4M, and 4K, respectively. As the secondary transfer roller 5*e* pressingly contacting an outer circumferential surface of the transfer belt 5*a* is pressed against the driving roller 5*b* via the transfer belt 5*a*, a secondary transfer nip is formed between the secondary transfer roller 5*e* and the transfer belt 5*a*. As a recording medium S is conveyed through the secondary transfer nip, the yellow, cyan, magenta, and black toner images carried on the transfer belt 5*a* are secondarily transferred onto the recording medium S collectively.

A detailed description is now given of a construction of the belt cleaner 6.

The belt cleaner 6 is situated between the secondary transfer nip and the sub process unit 4Y in the rotation direction A1 of the transfer belt 5*a*. The belt cleaner 6 includes a toner remover and the toner conveyance tube. The toner remover removes residual toner failed to be transferred onto the recording medium S and therefore remaining on the outer circumferential surface of the transfer belt 5*a* therefrom. The toner conveyance tube conveys the removed toner to the waste toner container as waste toner.

A detailed description is now given of a construction of the recording medium feeder 7.

The recording medium feeder 7, located in a lower portion of the body 2, includes a paper tray 7*a* that loads a plurality of recording media S and a feed roller 7*b* that picks up and feeds a recording medium S from the paper tray 7*a*. The feed roller 7*b* picks up an uppermost recording medium S from the plurality of recording media S loaded on the paper tray 7*a* and feeds the uppermost recording medium S to the conveyance path R.

A detailed description is now given of a construction of the output device 8.

The output device 8, disposed above the optical writer 3 and atop the body 2, includes an output tray 8*a* and an output roller pair 8*b* that feeds the recording medium S onto the output tray 8*a* that receives the recording medium S. The recording media S discharged from the conveyance path R by the output roller pair 8*b* are stacked on the output tray 8*a* one by one such that the recording media S are layered successively on the output tray 8*a*.

A detailed description is now given of a configuration of the registration roller pair 9.

The registration roller pair 9 adjusts conveyance of the recording medium S conveyed through the conveyance path R by the feed roller 7*b* of the recording medium feeder 7. For example, a registration sensor, located inside the body 2 at a position interposed between the feed roller 7*b* and the registration roller pair 9 in the conveyance path R, detects a leading edge of the recording medium S. When a predetermined time elapses after the registration sensor detects the leading edge of the recording medium S, the registration roller pair 9 interrupts rotation to temporarily halt the recording medium S that comes into contact with the registration roller pair 9. Thereafter, the registration roller pair 9 resumes rotation as it sandwiches the recording medium S at a predetermined time to convey the recording medium S to the secondary transfer nip. For example, the predetermined time is a time when the color toner image formed of the yellow, cyan, magenta, and black toner images superimposed on the transfer belt 5*a* reaches the secondary transfer nip as the transfer belt 5*a* rotates in the rotation direction A1.

Figure 2:
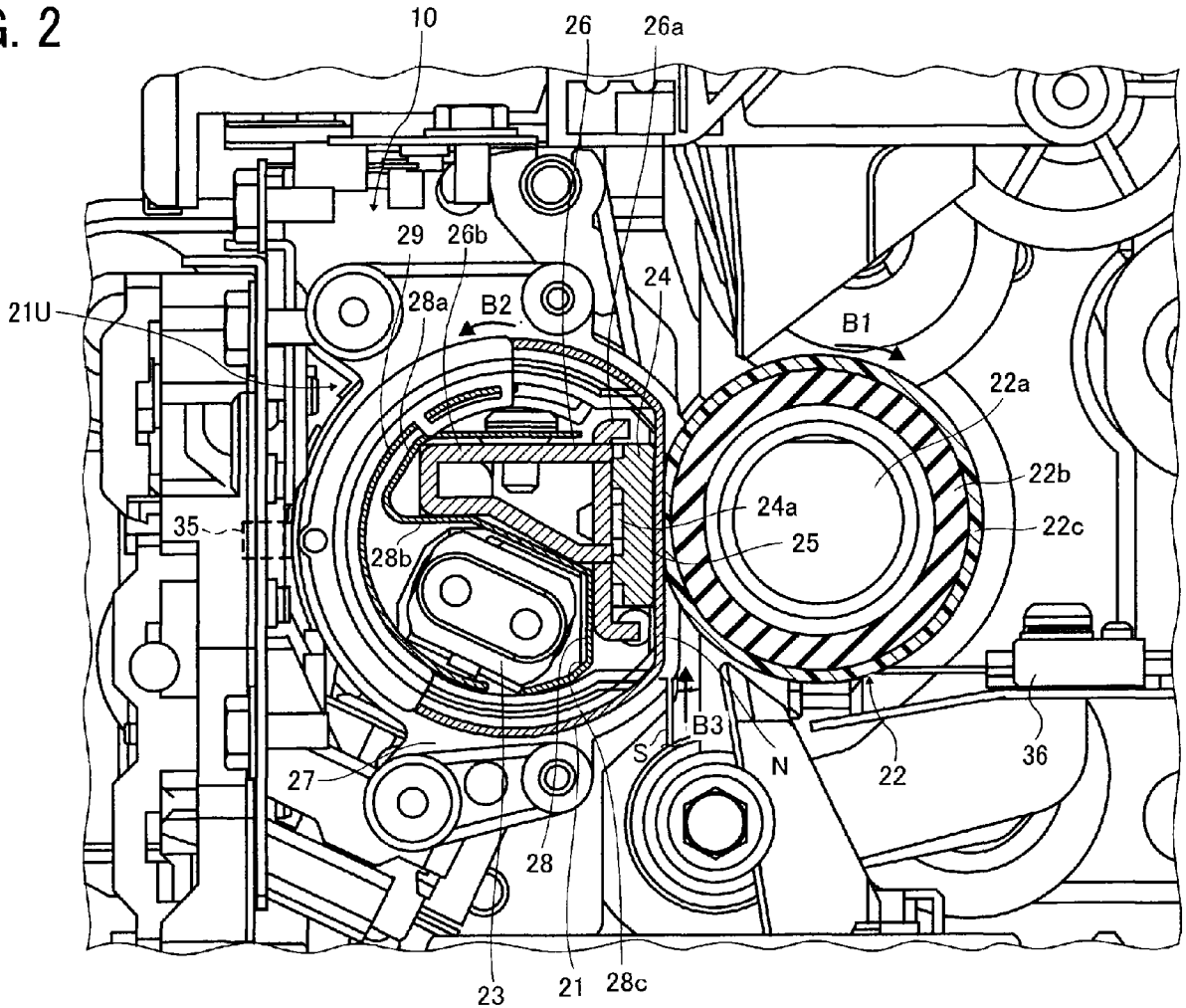
FIG. 2 is a vertical sectional view of a fixing device incorporated in the image forming apparatus shown in FIG. 1.

With reference to FIG. 2, a description is provided of a construction of the fixing device 10 incorporated in the image forming apparatus 1 described above.

FIG. 2 is a vertical sectional view of the fixing device 10. As shown in FIG. 2, the fixing device 10 (e.g., a fuser) includes a fixing belt 21 serving as a fixing rotator or an endless belt formed into a loop and rotatable in a rotation direction B2; a pressure roller 22 serving as a pressing rotator disposed opposite an outer circumferential surface of the fixing belt 21 to separably or inseparably contact the fixing belt 21 and rotatable in a rotation direction B1 counter to the rotation direction B2 of the fixing belt 21; a heater 23 disposed inside the loop formed by the fixing belt 21 and heating the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a slide member 25 over which the fixing belt 21 slides; a support 26 disposed inside the loop formed by the fixing belt 21 and supporting the nip formation pad 24; a holder 27 supporting the fixing belt 21; a reflector 28 disposed inside the loop formed by the fixing belt 21 to reflect light radiated from the heater 23 thereto toward the fixing belt 21; a heat shield 29 interposed between the heater 23 and the fixing belt 21 to shield the fixing belt 21 from light radiated from the heater 23; and a temperature sensor 35 serving as a temperature detector disposed opposite the heat shield 29 and detecting the temperature of the heat shield 29. The fixing belt 21 and the components disposed inside the loop formed by the fixing belt 21, that is, the heater 23, the nip formation pad 24, the slide member 25, the support 26, the reflector 28, and the heat shield 29, may constitute a belt unit 21U separably coupled with the pressure roller 22.

Figure 3:
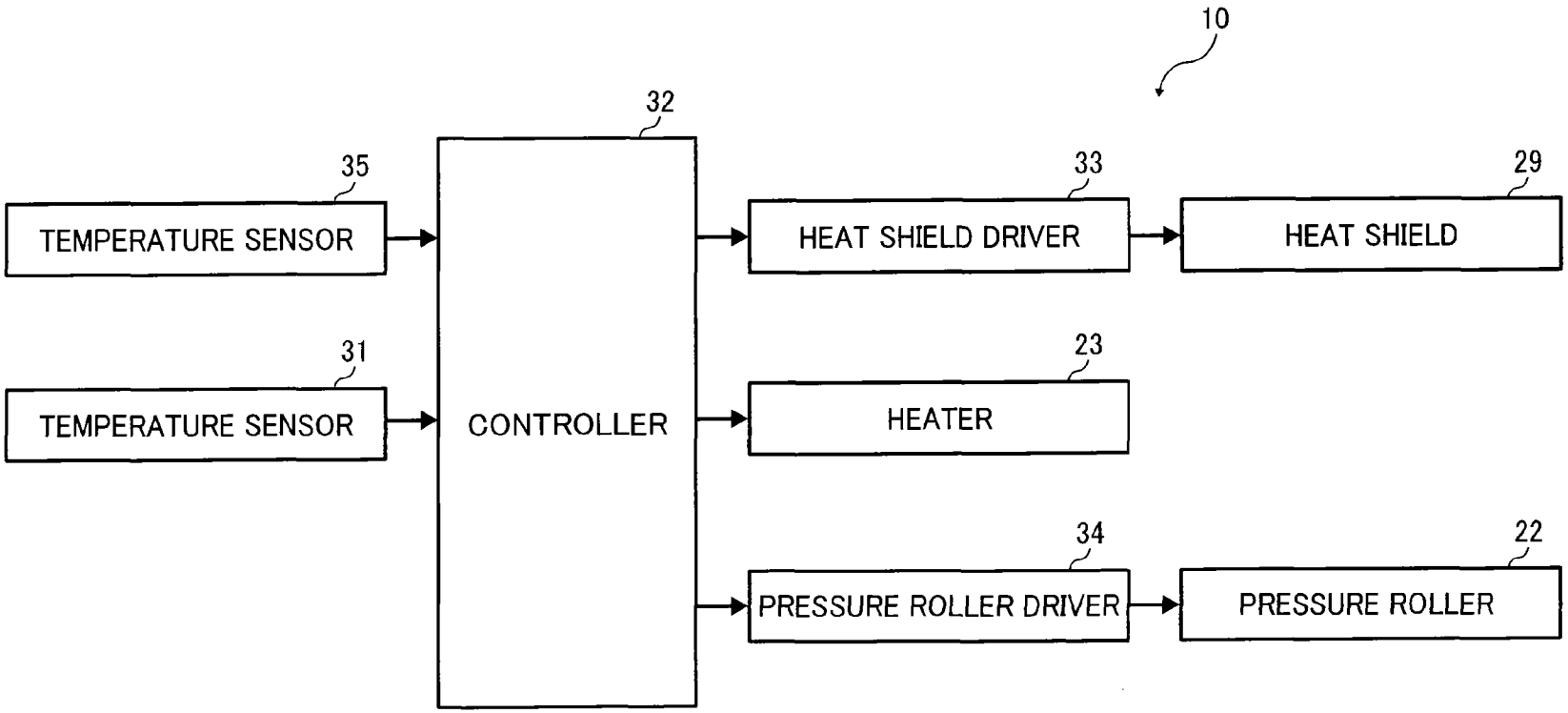
FIG. 3 is a block diagram of the fixing device shown in FIG. 2.

FIG. 3 is a block diagram of the fixing device 10. As shown in FIG. 3, the fixing device 10 further includes a heat shield driver 33 that drives and moves the heat shield 29, a pressure roller driver 34 that drives and rotates the pressure roller 22, and a controller 32 operatively connected to the temperature sensor 31, the heat shield driver 33, the heater 23, and the pressure roller driver 34. Alternatively, the controller 32 may be located inside the image forming apparatus 1.

The controller 32 (e.g., a processor) includes a micro computer constructed of devices such as a central processing unit (CPU), a read-only memory (ROM), a random access memory (RAM), and an interface circuit. The controller 32 controls the heater 23 based on the temperature of the fixing belt 21 detected by the temperature sensor 31. As shown in FIG. 2, a temperature sensor 36 contacts an outer circumferential surface of the pressure roller 22 to detect the temperature of the pressure roller 22. The controller 32 may control the heater 23 based on the temperature of the pressure roller 22 detected by the temperature sensor 36.

As a recording medium S bearing a toner image transferred from the transfer belt 5*a* depicted in FIG. 1 is conveyed through the fixing nip N formed between the fixing belt 21 and the pressure roller 22 depicted in FIG. 2, the fixing belt 21 heated by the heater 23 and the pressure roller 22 apply heat and pressure to the recording medium S, thus fixing the toner image on the recording medium S. As the recording medium S bearing the fixed toner image is discharged from the fixing nip N, the recording medium S is separated from the fixing belt 21 and conveyed to the output roller pair 8*b* through the conveyance path R depicted in FIG. 1.

A detailed description is now given of a construction of the fixing belt 21.

The fixing belt 21 is constructed of a base layer; an elastic layer coating an outer circumferential surface of the base layer; and a release layer coating an outer circumferential surface of the elastic layer. The fixing belt 21 is a flexible belt having a thickness of about 1 mm. A longitudinal direction, that is, an axial direction, of the fixing belt 21 is parallel to a width direction of the recording medium S conveyed over the outer circumferential surface of the fixing belt 21. The fixing belt 21 is formed in a ring having a loop diameter of about 25 mm in cross-section perpendicular to the width direction of the recording medium S.

Alternatively, the fixing belt 21 may not incorporate the elastic layer. If the fixing belt 21 does not incorporate the elastic layer, the fixing belt 21 has a decreased thermal capacity that enhances heat conduction, saving energy. The loop diameter of the fixing belt 21 is selectively determined within a range of from about 15 mm to about 120 mm according to settings of the fixing device 10.

The fixing belt 21 rotates in the rotation direction B2 in accordance with rotation of the pressure roller 22 rotating in the rotation direction B1. Hence, the fixing belt 21 is driven by the pressure roller 22. The fixing belt 21 and the pressure roller 22, as they rotate, convey the recording medium S entering the fixing nip N in a recording medium conveyance direction B3 and discharge the recording medium S from the fixing nip N. Alternatively, the pressure roller driver 34 depicted in FIG. 3 or another driver may be connected to the fixing belt 21 to drive and rotate the fixing belt 21.

A detailed description is now given of a construction of the pressure roller 22.

The pressure roller 22 is constructed of a roll 22*a* serving as a core metal; an elastic layer 22*b* coating an outer circumferential surface of the roll 22*a*; and a release layer 22*c* coating an outer circumferential surface of the elastic layer 22*b*. The pressure roller driver 34 located inside the body 2 of the image forming apparatus 1 depicted in FIG. 1 drives and rotates the pressure roller 22. The pressure roller driver 34 is constructed of a driving section such as a motor and a reduction section such as a reduction gear. A pressurization assembly presses the pressure roller 22 against the nip formation pad 24 via the fixing belt 21. As the pressure roller 22 is pressed against the nip formation pad 24, the elastic layer 22*b* of the pressure roller 22 is pressed and elastically deformed to define a part of the fixing nip N.

A detailed description is now given of a construction of the heater 23.

The heater 23 is disposed opposite the inner circumferential surface of the fixing belt 21 and mounted on the body 2 at a position spaced apart from the fixing belt 21. The heater 23 has a heating span or a radiation span where the heater 23 irradiates the fixing belt 21 directly with light that generates radiation heat. The heater 23 is a radiant heater, for example, a halogen heater including a halogen lamp that heats the fixing belt 21 directly, a carbon heater including a quartz tube manufactured by filling inert gas with carbon fiber, a ceramic heater constructed of resistant wiring embedded in ceramic, or the like. The controller 32 controls power supply to the heater 23 by turning on and off the heater 23.

A detailed description is now given of a configuration of the nip formation pad 24.

The nip formation pad 24 is made of a rigid material. A longitudinal direction of the nip formation pad 24 is parallel to the width direction of the recording medium S conveyed through the fixing nip N. The nip formation pad 24 is formed in substantially a rectangle in cross-section perpendicular to the width direction of the recording medium S. The nip formation pad 24 disposed inside the loop formed by the fixing belt 21 presses against the pressure roller 22 via the fixing belt 21 to form the fixing nip N between the fixing belt 21 and the pressure roller 22. According to this exemplary embodiment, the fixing nip N is planar in cross-section. Alternatively, the fixing nip N may be concave or curved in cross-section with respect to the pressure roller 22. If the fixing nip N is concave, the concave fixing nip N directs a leading edge of the recording medium S toward the pressure roller 22, facilitating separation of the recording medium S from the fixing nip N and therefore preventing the recording medium S from being jammed between the fixing belt 21 and the pressure roller 22. The slide member 25 adjoins an outer circumferential surface of the nip formation pad 24. The nip formation pad 24 includes a joint 24*a* that adjoins the support 26. Thus, the nip formation pad 24 is mounted on the body 2 of the image forming apparatus 1 depicted in FIG. 1 through the joint 24*a*.

A detailed description is now given of a configuration of the slide member 25.

The slide member 25 is made of a material having an increased mechanical strength in view of resistance to abrasion, heat, friction, and the like. For example, the slide member 25 is made of resin such as PFA and PTFE. The slide member 25 is a sheet having a thickness in a range of from about 50 micrometers to about 2,500 micrometers. The slide member 25 is adhered to the outer circumferential surface of the nip formation pad 24, thus being attached to the nip formation pad 24. Alternatively, the slide member 25 is formed in a film having a predetermined thickness by applying resin such as PFA and PTFE to the outer circumferential surface of the nip formation pad 24.

A detailed description is now given of a configuration of the support 26.

Similar to the nip formation pad 24, a longitudinal direction of the support 26 is parallel to the width direction of the recording medium S. In view of shape, the support 26 includes a bent section disposed opposite the heater 23 and bent in cross-section perpendicular to the longitudinal direction of the support 26 and a planar section opposite the bent section and planar in cross-section perpendicular to the longitudinal direction of the support 26. In view of function, the support 26 includes a support portion 26*a* supporting the nip formation pad 24 and a holding portion 26*b* holding the reflector 28. The support portion 26*a* of the support 26 adjoins the joint 24*a* of the nip formation pad 24 to support the nip formation pad 24 against pressure from the pressure roller 22, preventing the nip formation pad 24 from being bent in the width direction of the recording medium S. Thus, the nip formation pad 24 retains the length of the fixing nip N that is even throughout the entire width of the recording medium S. Similar to the nip formation pad 24, the support 26 is situated inside the loop formed by the fixing belt 21 and mounted on the body 2 of the image forming apparatus 1 depicted in FIG. 1.

A detailed description is now given of a configuration of the holder 27.

The holder 27 is situated outside the loop formed by the fixing belt 21 and mounted on the body 2 of the image forming apparatus 1. The holder 27 holds both lateral ends of the support 26 in the longitudinal direction thereof and positions the support 26 with respect to the body 2 of the image forming apparatus 1. Additionally, the holder 27 guides both lateral ends of the fixing belt 21 in the axial direction thereof, preventing the fixing belt 21 from being skewed in the axial direction thereof as the fixing belt 21 rotates.

A detailed description is now given of a construction of the reflector 28.

The reflector 28 is constructed of a mounted portion 28*a* mounted on the body 2 of the image forming apparatus 1, a reflection face 28*b*, and a curved face 28*c*. The reflection face 28*b* reflects light emitted from the heater 23 thereto toward the inner circumferential surface of the fixing belt 21. The mounted portion 28*a* is disposed at each lateral end of the reflector 28 in a longitudinal direction thereof parallel to the width direction of the recording medium S. Thus, the reflector 28 is mounted on the body 2 of the image forming apparatus 1 at the mounted portions 28*a*. The reflection face 28*b* is interposed between the support 26 and the heater 23. The curved face 28*c* is disposed opposite the heater 23 and curved to surround the heater 23.

The reflector 28 reflects light or heat radiated from the heater 23 thereto onto the fixing belt 21 effectively, enhancing conduction of heat to the fixing belt 21, suppressing conduction of heat from the heater 23 to the support 26, and thereby suppressing waste of energy. Alternatively, instead of the reflector 28, an opposed face of the support 26 disposed opposite the heater 23 may be treated with mirror finish to reflect light radiated from the heater 23 onto the support 26 toward the fixing belt 21 like the reflector 28. Yet alternatively, an inner circumferential surface of the bent section of the support 26 disposed opposite the heater 23 may be made of a heat insulator to insulate the support 26 from the heater 23, thus suppressing heat conduction from the heater 23 to the support 26.

A detailed description is now given of a configuration of the heat shield 29.

The heat shield 29 is interposed between the heater 23 and the fixing belt 21 to shield the fixing belt 21 from radiation heat generated by light from the heater 23 according to the size of the recording medium S. The heat shield 29 includes an opposed face disposed opposite the heater 23 that is curved and concave with respect to the heater 23 in cross-section perpendicular to the width direction of the recording medium S. The heat shield 29 is installed inside the body 2 of the image forming apparatus 1 depicted in FIG. 1 such that the heat shield 29 is rotatable in a circumferential direction of the fixing belt 21. For example, the heat shield driver 33 depicted in FIG. 3 drives and rotates the heat shield 29 to change an axial shield span of the fixing belt 21 where the heat shield 29 shields the fixing belt 21 from the heater 23 according to the size of the recording medium S conveyed through the fixing nip N.

With reference to FIGS. 4A to 5D, a description is provided of movement of the heat shield 29.

Figure 4A:
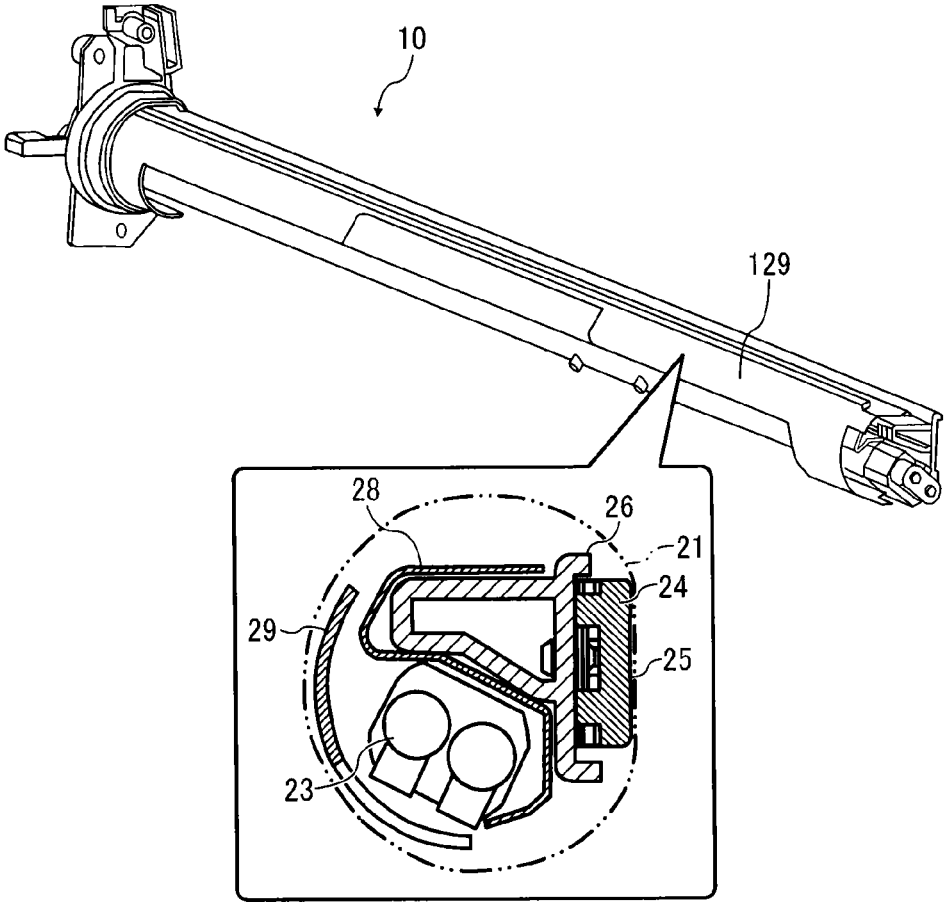
FIG. 4A illustrates a partial perspective view and a partial vertical sectional view of the fixing device shown in FIG. 2 illustrating the position of a heat shield incorporated therein when an A3 size recording medium is conveyed through the fixing device.
Figure 4B:
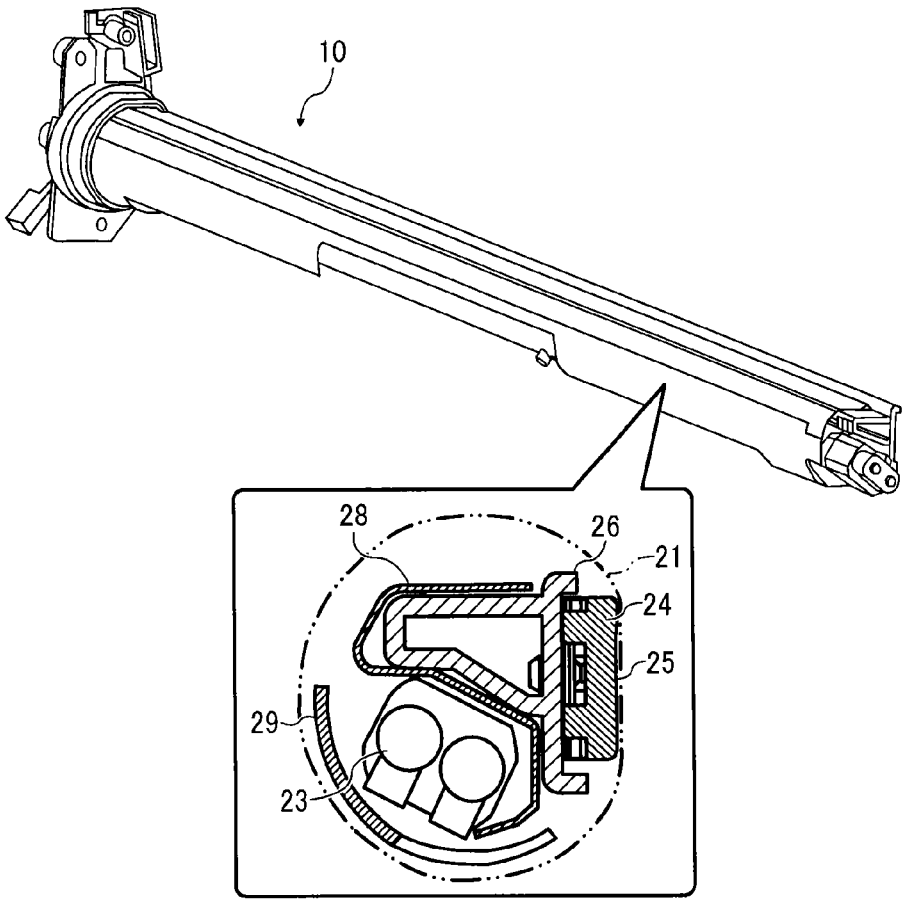
FIG. 4B illustrates a partial perspective view and a partial vertical sectional view of the fixing device shown in FIG. 2 illustrating the position of the heat shield when a postcard is conveyed through the fixing device.
Figure 5A:
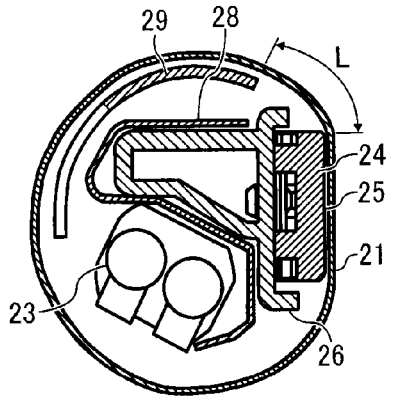
FIG. 5A is a vertical sectional view of a fixing belt incorporated in the fixing device shown in FIG. 2 and components located inside the fixing belt illustrating a home position of the heat shield.
Figure 5B:
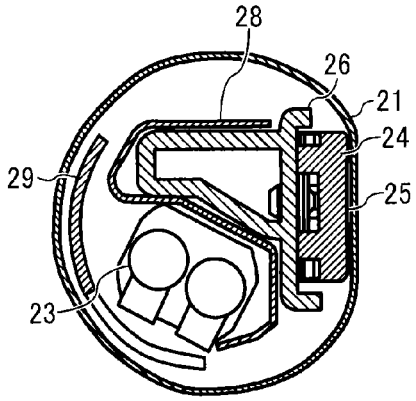
FIG. 5B is a vertical sectional view of the fixing belt and the components located inside the fixing belt shown in FIG. 5A illustrating a first position of the heat shield.
Figure 5C:
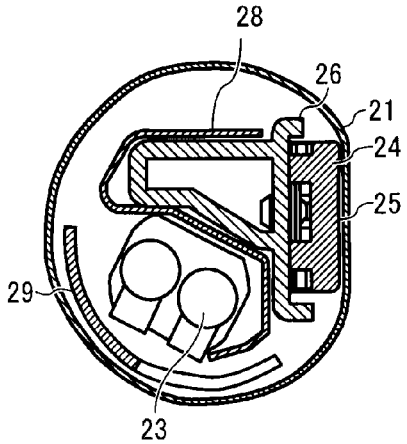
FIG. 5C is a vertical sectional view of the fixing belt and the components located inside the fixing belt shown in FIG. 5A illustrating a second position of the heat shield.
Figure 5D:
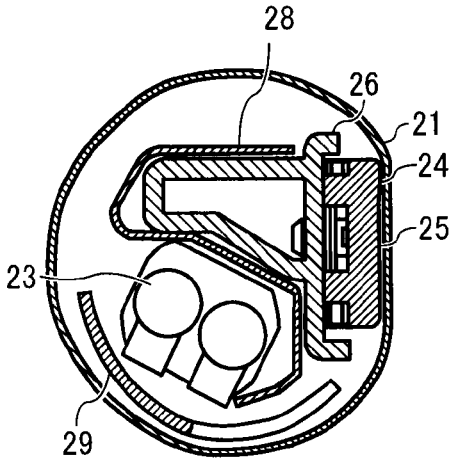
FIG. 5D is a vertical sectional view of the fixing belt and the components located inside the fixing belt shown in FIG. 5A illustrating a third position of the heat shield.

FIG. 4A is a perspective view and a partial vertical sectional view of the fixing device 10 illustrating the position of the heat shield 29 when an A3 size recording medium is conveyed through the fixing device 10. FIG. 4B is a perspective view and a partial vertical sectional view of the fixing device 10 illustrating the position of the heat shield 29 when a postcard is conveyed through the fixing device 10. FIG. 5A is a vertical sectional view of the fixing belt 21 and the components located inside the fixing belt 21 illustrating a home position of the heat shield 29. FIG. 5B is a vertical sectional view of the fixing belt 21 and the components located inside the fixing belt 21 illustrating a first position of the heat shield 29. FIG. 5C is a vertical sectional view of the fixing belt 21 and the components located inside the fixing belt 21 illustrating a second position of the heat shield 29. FIG. 5D is a vertical sectional view of the fixing belt 21 and the components located inside the fixing belt 21 illustrating a third position of the heat shield 29. It is to be noted that a cross-sectional portion of the heat shield 29 that is disposed opposite the postcard conveyed over the fixing belt 21 is crosshatched in FIGS. 4A to 5D.

The heat shield 29 is movable between the home position shown in FIG. 5A, the first position shown in FIG. 5B, the second position shown in FIG. 5C, and the third position shown in FIG. 5D. FIG. 5A illustrates the heat shield 29 at the home position where the heat shield 29 shields the fixing belt 21 from the heater 23 in a minimum axial shield span of the fixing belt 21, that is, the heat shield 29 does not shield the fixing belt 21 from the heater 23. Thus, the heat shield 29 allows the heater 23 to heat the fixing belt 21 throughout the axial span thereof.

The heat shield 29 at the home position is situated in proximity to the nip formation pad 24 with a decreased interval L therebetween in the circumferential direction of the fixing belt 21. Alternatively, the heat shield 29 at the home position may contact the nip formation pad 24 with no interval L therebetween.

The heat shield 29 at the home position does not shield the fixing belt 21 from the heater 23 and therefore allows the heater 23 to heat the fixing belt 21 in an increased amount of heat. Alternatively, as shown in FIGS. 2 and 3, the fixing device 10 may include the temperature sensor 35 operatively connected to the controller 32 to detect the temperature of the heat shield 29. In this case, the controller 32 changes the interval L between the heat shield 29 and the nip formation pad 24 based on the temperature of the heat shield 29 detected by the temperature sensor 35, that is, an amount of heat stored in the heat shield 29.

For example, when the heat shield 29 stores an increased amount of heat, the interval L is decreased to conduct heat stored in the heat shield 29 to the nip formation pad 24 so as to increase the temperature of the nip formation pad 24. Conversely, when the heat shield 29 stores a decreased amount of heat and has a temperature lower than that of the nip formation pad 24, the interval L is increased to prohibit the heat shield 29 from drawing heat from the nip formation pad 24.

FIG. 5D illustrates the heat shield 29 at the third position where the heat shield 29 shields the fixing belt 21 from the heater 23 in a maximum axial shield span of the fixing belt 21. The heat shield 29 at the third position allows the heater 23 to heat the fixing belt 21 in a minimum amount of heat.

The first position shown in FIG. 5B and the second position shown in FIG. 5C are interposed between the home position shown in FIG. 5A and the third position shown in FIG. 5D in the circumferential direction of the fixing belt 21. The first position and the second position of the heat shield 29 are selected according to various conditions of the fixing device 10, that is, the configuration, shape, size, and thermal capacity of the fixing device 10.

Figure 6:
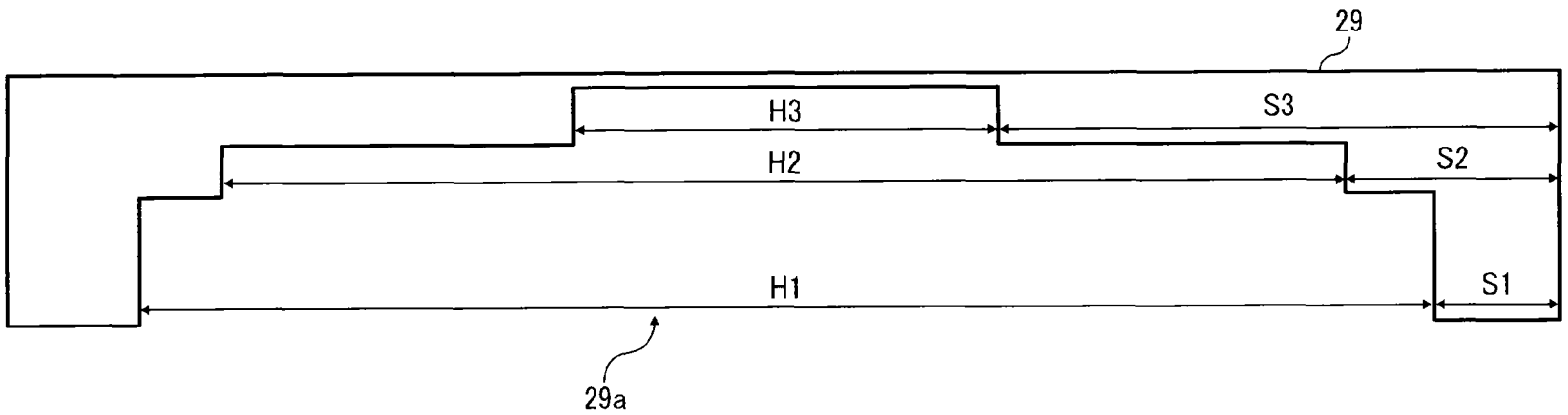
FIG. 6 is a development of the heat shield shown in FIG. 4B.

FIG. 6 is a development of the heat shield 29. As shown in FIG. 6, the heat shield 29 includes a recess 29*a* contoured to produce three axial heating spans where the heat shield 29 allows the heater 23 to heat the fixing belt 21, that is, a great axial heating span H1, a medium axial heating span H2, and a small axial heating span H3. When the recording medium S is an A3 size recording medium, the heat shield 29 moves to the first position shown in FIG. 5B where the heat shield 29 is disposed opposite the heater 23 in a small axial shield span S1 disposed at each lateral end of the heat shield 29 in a longitudinal direction thereof parallel to the axial direction of the fixing belt 21. Thus, the heat shield 29 allows the heater 23 to heat the fixing belt 21 in the great axial heating span H1 corresponding to the width of the A3 size recording medium. When the recording medium S is a B4 size recording medium, the heat shield 29 moves to the second position shown in FIG. 5C where the heat shield 29 is disposed opposite the heater 23 in a medium axial shield span S2 disposed at each lateral end of the heat shield 29 in the longitudinal direction thereof that is greater than the small axial shield span S1. Thus, the heat shield 29 allows the heater 23 to heat the fixing belt 21 in the medium axial heating span H2 corresponding to the width of the B4 size recording medium. When the recording medium S is a small recording medium, for example, a postcard, the heat shield 29 moves to the third position shown in FIG. 5D where the heat shield 29 is disposed opposite the heater 23 in a great axial shield span S3 disposed at each lateral end of the heat shield 29 in the longitudinal direction thereof that is greater than the medium axial shield span S2. Thus, the heat shield 29 allows the heater 23 to heat the fixing belt 21 in the small axial heating span H3 corresponding to the width of the postcard.

The heat shield 29 moves in accordance with the size of the recording medium S to shield the axial span of the fixing belt 21 that is not required to be heated. Accordingly, even if a plurality of small recording media S is conveyed over the fixing belt 21 continuously, a non-conveyance span of the fixing belt 21 where the small recording media are not conveyed is not heated unnecessarily or does not overheat. Consequently, the controller 32 does not perform unproductive control that may degrade productivity of the fixing device 10 to prevent overheating. Additionally, the number of halogen heaters constituting the heater 23 is reduced from three to two, for example, at reduced manufacturing costs, saving energy.

With reference to FIG. 1, a brief description is provided of an image forming operation of the image forming apparatus 1 to form a color toner image on a recording medium S.

As a print job starts, a driver drives and rotates the photoconductive drums 4*d* of the sub process units 4Y, 4C, 4M, and 4K, respectively, clockwise in FIG. 1. The charging rollers 4*r* uniformly charge the outer circumferential surface of the respective photoconductive drums 4*d* at a predetermined polarity. The optical writer 3 emits laser beams Lb onto the charged outer circumferential surface of the respective photoconductive drums 4*d* according to yellow, cyan, magenta, and black image data contained in color image data sent from the external device, respectively, thus forming electrostatic latent images thereon. The development devices 4*g* supply yellow, cyan, magenta, and black toners to the electrostatic latent images formed on the photoconductive drums 4*d*, visualizing the electrostatic latent images into yellow, cyan, magenta, and black toner images, respectively.

As a driver drives and rotates the driving roller 5*b* counterclockwise in FIG. 1, the driving roller 5*b* rotates the transfer belt 5*a* counterclockwise in FIG. 1 in the rotation direction A1 by friction therebetween. The power supply applies a constant voltage or a constant current control voltage having a polarity opposite a polarity of the charged toner to the primary transfer rollers 5*d*Y, 5*d*C, 5*d*M, ad 5*d*K, creating a transfer electric field at the respective primary transfer nips formed between the photoconductive drums 4*d* and the primary transfer rollers 5*d*Y, 5*d*C, 5*d*M, and 5*d*K. Accordingly, the yellow, cyan, magenta, and black toner images formed on the photoconductive drums 4*d* of the sub process units 4Y, 4C, 4M, and 4K are primarily transferred from the photoconductive drums 4*d* onto the transfer belt 5*a* by the transfer electric field created at the primary transfer nips such that the yellow, cyan, magenta, and black toner images are superimposed successively on a same position on the transfer belt 5*a*. Thus, a color toner image is formed on the outer circumferential surface of the transfer belt 5*a*.

After the primary transfer of the yellow, cyan, magenta, and black toner images from the photoconductive drums 4*d* onto the transfer belt 5*a*, the cleaning blades 4*b* remove residual toner failed to be transferred onto the transfer belt 5*a* and therefore remaining on the photoconductive drums 4*d* therefrom. Thereafter, dischargers discharge the outer circumferential surface of the respective photoconductive drums 4*d* by removing electric charge, initializing the surface potential thereof and rendering the photoconductive drums 4*d* to be ready for a next print job.

As the development devices 4*g* start supplying yellow, cyan, magenta, and black toners to the electrostatic latent images formed on the photoconductive drums 4*d* to form yellow, cyan, magenta, and black toner images, respectively, the feed roller 7*b* situated in the lower portion of the body 2 starts rotation. The feed roller 7*b* picks up and feeds an uppermost recording medium S of a plurality of recording media S loaded on the paper tray 7*a* to the conveyance path R. The registration roller pair 9 conveys the recording medium S sent to the conveyance path R by the feed roller 7*b* to the secondary transfer nip formed between the secondary transfer roller 5*e* and the transfer belt 5*a* at a proper time. The secondary transfer roller 5*e* is applied with a transfer voltage having a polarity opposite a polarity of the yellow, cyan, magenta, and black toner images formed on the transfer belt 5*a*, producing a transfer electric field at the secondary transfer nip.

The transfer electric field secondarily transfers the yellow, cyan, magenta, and black toner images formed on the transfer belt 5*a* onto the recording medium S collectively, thus forming a color toner image on the recording medium S. The recording medium S bearing the color toner image is conveyed to the fixing device 10 where the fixing belt 21 and the pressure roller 22 form the fixing nip N. As the recording medium S is conveyed through the fixing nip N, the fixing belt 21 applies heat to the recording medium S and at the same time the pressure roller 22, together with the fixing belt 21, exerts pressure to the recording medium S, melting and fixing the toner image on the recording medium S.

As shown in FIG. 2, as the recording medium S is conveyed through the fixing device 10, the heat shield 29 rotates and moves to a desired position according to the size of the recording medium S, shielding the fixing belt 21 from the heater 23 in a non-conveyance span where the recording medium S is not conveyed over the fixing belt 21 and therefore heating is unnecessary. Conversely, in a conveyance span where the recording medium S is conveyed over the fixing belt 21 and therefore heating is necessary, the heat shield 29 allows the heater 23 to heat the fixing belt 21 directly.

The recording medium S bearing the toner image fixed thereon is separated from the fixing belt 21 by a separator. Thereafter, the recording medium S bearing the fixed toner image is discharged onto the output tray 8*a* of the output device 8 by the output roller pair 8*b* depicted in FIG. 1. After the secondary transfer of the color toner image from the transfer belt 5*a* onto the recording medium S, the belt cleaner 6 removes residual toner failed to be transferred onto the recording medium S and therefore remaining on the transfer belt 5*a* therefrom. The removed toner is conveyed and collected into the waste toner container.

The above describes the image forming operation of the image forming apparatus 1 to form the color toner image on the recording medium S. Alternatively, the image forming apparatus 1 may form a monochrome toner image by using any one of the four sub process units 4Y, 4C, 4M, and 4K or may form a bicolor or tricolor toner image by using two or three of the sub process units 4Y, 4C, 4M, and 4K.

When the fixing belt 21 finishes heating the recording medium S conveyed through the fixing nip N and the heater 23 is turned off, thus finishing heating the fixing belt 21, the fixing belt 21 performs supplemental rotation different from fixing rotation that the fixing belt 21 performs while the fixing belt 21 heats the recording medium S. Accordingly, before the heater 23 is cooled, that is, while the heater 23 retains residual heat, the heat shield 29 and the fixing belt 21 are not heated locally by residual heat and therefore are immune from overheating.

Supplemental rotation of the fixing belt 21 levels the temperature of the fixing belt 21, conducts residual heat from the heater 23 to the fixing belt 21 evenly in the circumferential direction thereof, and suppresses local heating of the fixing belt 21, thus reducing temperature variation of the fixing belt 21. Accordingly, temperature variation is reduced in the circumferential direction of the fixing belt 21, preventing local plastic deformation of the fixing belt 21, i.e., kink caused by heat.

Supplemental rotation of the fixing belt 21 may be performed when the temperature of the fixing belt 21 detected by the temperature sensor 31 is not lower than a predetermined temperature. Alternatively, a supplemental rotation time may be changed according to the temperature of the fixing belt 21. Yet alternatively, supplemental rotation may start immediately after the heater 23 finishes heating the fixing belt 21 and continue for a preset time.

The controller 32 moves the heat shield 29 to the home position shown in FIG. 5A when the fixing belt 21 starts supplemental rotation. Alternatively, before the fixing belt 21 starts supplemental rotation, the controller 32 may retain the heat shield 29 at the position other than the home position shown in FIG. 5A, that is, the first position shown in FIG. 5B, the second position shown in FIG. 5C, and the third position shown in FIG. 5D. After the fixing belt 21 starts supplemental rotation, the controller 32 may move the heat shield 29 to the home position shown in FIG. 5A.

Supplemental rotation of the fixing belt 21 may be performed at a time other than the time when the fixing belt 21 finishes heating the recording medium S and the heater 23 finishes heating the fixing belt 21.

For example, supplemental rotation of the fixing belt 21 may be performed to clean the fixing belt 21. Cleaning of the fixing belt 21 is performed periodically every time the predetermined number of recording media S is conveyed through the fixing nip N, for example, every time 10,000 sheets of recording media S are conveyed through the fixing nip N. Alternatively, supplemental rotation of the fixing belt 21 may be performed to prevent deformation of the pressure roller 22. For example, supplemental rotation of the fixing belt 21 is performed periodically if the pressure roller 22 is an elastic roller such as a sponge roller. Accordingly, supplemental rotation of the fixing belt 21 prevents plastic deformation of the fixing nip N caused by compressive strain exerted on the nip formation pad 24 as the pressure roller 22 is pressed against the nip formation pad 24.

A description is provided of advantages of the fixing device 10 described above.

As shown in FIGS. 2 and 3, the fixing device 10 includes the fixing belt 21, the pressure roller 22, the heater 23, the nip formation pad 24, and the heat shield 29 movable to shield the fixing belt 21 from the heater 23 in a variable axial shield span of the fixing belt 21. The fixing belt 21, together with the pressure roller 22, performs fixing rotation to convey the recording medium S through the fixing nip N while heating the recording medium S. The fixing belt 21 performs supplemental rotation other than fixing rotation. During supplemental rotation of the fixing belt 21, the controller 32 moves the heat shield 29 to a decreased shield span position, that is, the home position shown in FIG. 5A where the heat shield 29 shields the fixing belt 21 from the heater 23 in the minimum axial shield span of the fixing belt 21.

Accordingly, after the fixing belt 21 finishes heating the recording medium S, residual heat from the heater 23 is used effectively, saving energy and fixing the toner image on the recording medium S properly. During supplemental rotation of the fixing belt 21 other than fixing rotation, the controller 32 moves the heat shield 29 to the decreased shield span position (e.g., the home position shown in FIG. 5A) where the heat shield 29 shields the fixing belt 21 from the heater 23 in the minimum axial shield span of the fixing belt 21, facilitating direct conduction of residual heat from the heater 23 to the fixing belt 21. Additionally, residual heat is conducted from the heat shield 29 to the fixing belt 21 directly which in turn is conducted from the fixing belt 21 to the pressure roller 22 and the nip formation pad 24. If the heat shield 29 does not move to the home position shown in FIG. 5A where the heat shield 29 shields the fixing belt 21 from the heater 23 in the minimum axial shield span of the fixing belt 21, residual heat is conducted from the heater 23 to the heat shield 29. If the heat shield 29 is heated by residual heat from the heater 23, residual heat of the heater 23 is not conducted to the fixing belt 21 and therefore the fixing belt 21 does not heat the pressure roller 22 and other peripheral components effectively.

To address this circumstance, according to this exemplary embodiment, during supplemental rotation of the fixing belt 21, the heat shield 29 moves to the decreased shield span position, that is, the home position shown in FIG. 5A, where the heat shield 29 shields the fixing belt 21 from the heater 23 in a decreased axial shield span, that is, the minimum axial shield span, of the fixing belt 21, allowing residual heat of the heater 23 and the heat shield 29 to conduct to the fixing belt 21 effectively and therefore saving energy. As the temperature of the pressure roller 22 increases as the pressure roller 22 receives residual heat from the heater 23 and the heat shield 29, the pressure roller 22 and other peripheral components draw heat from the fixing belt 21 in a decreased amount before a next fixing job starts. Accordingly, the fixing device 10 improves its fixing performance. For example, the fixing belt 21 is heated to a desired fixing temperature quickly upon receipt of the next fixing job, saving energy.

Before supplemental rotation of the fixing belt 21 starts, the heat shield 29 is at the position other than the home position shown in FIG. 5A, that is, an increased shield span position such as the first position shown in FIG. 5B, the second position shown in FIG. 5C, and the third position shown in FIG. 5D. Conversely, after supplemental rotation of the fixing belt 21 starts, the heat shield 29 moves to the home position shown in FIG. 5A.

Since the heat shield 29 is at the position other than the home position shown in FIG. 5A until the fixing belt 21 starts supplemental rotation, residual heat is conducted from the heater 23 to the heat shield 29. Additionally, while the heat shield 29 is at the position other than the home position shown in FIG. 5A, residual heat is conducted from the heater 23 to the fixing belt 21 directly.

Accordingly, the fixing belt 21 is heated in an increased circumferential span thereof having an increased area, that is, a circumferential heating span that receives residual heat from the heater 23 and a circumferential heating span that receives residual heat from the heat shield 29, reducing temperature variation of the fixing belt 21 as it rotates, for example, during rotation to prevent overheating. Consequently, during the next fixing job, the fixing belt 21 is immune from temperature variation that may result in variation in gloss of the toner image fixed on the recording medium S under heat from the fixing belt 21. When the heat shield 29 is cool, the heat shield 29 is disposed opposite the heater 23 so as to be heated by the heater 23, allowing the fixing belt 21 to be heated by residual heat from the heat shield 29 effectively until the fixing belt 21 starts rotation to prevent overheating.

As shown in FIG. 5A, when the heat shield 29 is at the decreased shield span position, that is, the home position, where the heat shield 29 shields the fixing belt 21 from the heater 23 in the decreased axial shield span, the interval L between the heat shield 29 and the nip formation pad 24 is decreased.

As the heat shield 29 moves closer to the nip formation pad 24, the heat shield 29 heats the nip formation pad 24 which in turn heats the fixing belt 21 sufficiently for the next fixing job. Accordingly, the nip formation pad 24 stores heat, preventing toner peeled off the toner image on the recording medium S from adhering to the fixing belt 21 that may result in formation of a faulty toner image such as an offset toner image.

Figure 5E:
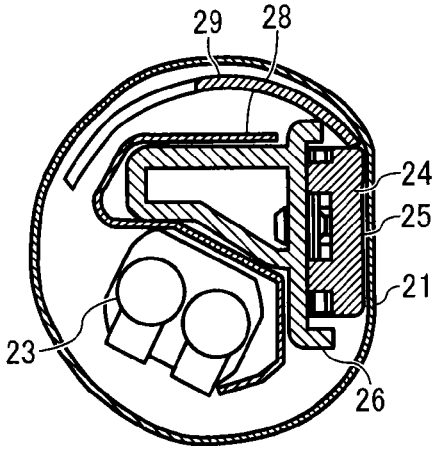
FIG. 5E is a vertical sectional view of the fixing belt and the components located inside the fixing belt illustrating the heat shield in contact with a nip formation pad.

Alternatively, when the heat shield 29 is at the decreased shield span position where the heat shield 29 shields the fixing belt 21 from the heater 23 in the decreased axial shield span, the heat shield 29 may contact the nip formation pad 24 as shown in FIG. 5E. FIG. 5E is a vertical sectional view of the fixing belt 21 and the components located inside the fixing belt 21 illustrating the heat shield 29 in contact with the nip formation pad 24. The heat shield 29 in contact with the nip formation pad 24 heats the nip formation pad 24 directly, causing the nip formation pad 24 to store heat and prevent formation of a faulty toner image such as an offset toner image.

The interval L between the heat shield 29 and the nip formation pad 24 may vary depending on the temperature of the heat shield 29. If the heat shield 29 is in proximity to the nip formation pad 24 when the heat shield 29 is cool, the heat shield 29 may draw heat from the nip formation pad 24 that forms the fixing nip N. To address this circumstance, the interval L between the heat shield 29 and the nip formation pad 24 is increased to prevent the heat shield 29 from drawing heat from the nip formation pad 24.

The image forming apparatus 1 depicted in FIG. 1 incorporates the fixing device 10 in which the heat shield 29 allows the heater 23 to heat the fixing belt 21 effectively with residual heat after the fixing belt 21 finishes heating the recording medium S conveyed through the fixing nip N. Thus, the image forming apparatus 1 saves energy. The fixing device 10 improves its fixing property of heating the fixing belt 21 quickly for the next fixing job and prevents formation of a faulty toner image such as an offset image. Accordingly, the fixing device 10 fixes the toner image on the recording medium S properly and the image forming apparatus 1 incorporating the fixing device 10 forms the high quality toner image on the recording medium S.

Figure 7:
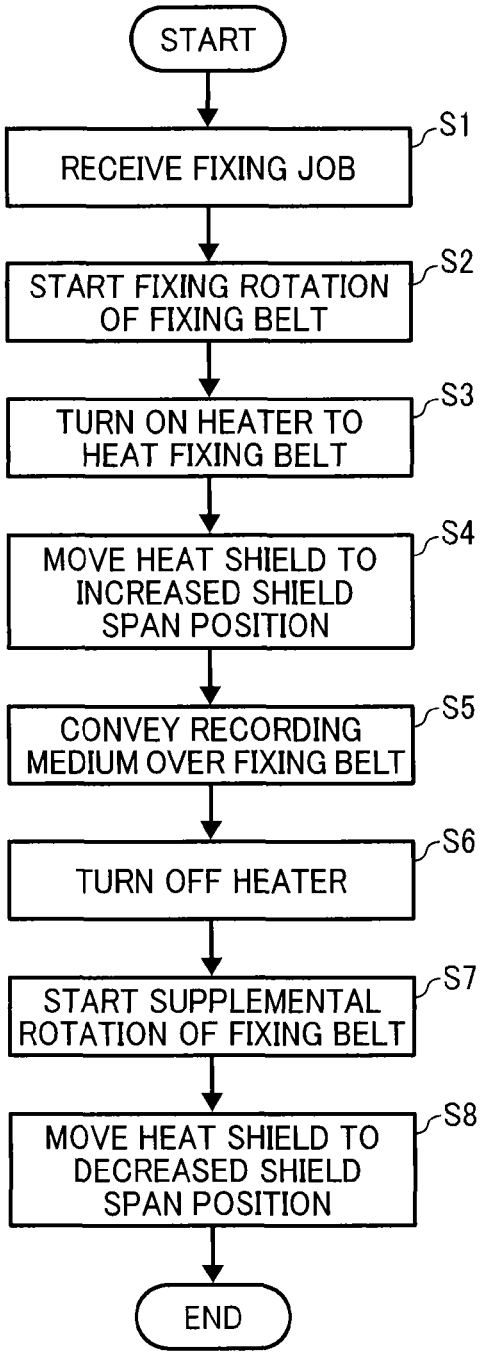
FIG. 7 is a flowchart showing control processes performed by a controller incorporated in the fixing device shown in FIG. 3.

With reference to FIGS. 3 and 7, a description is provided of control processes performed by the controller 32 depicted in FIG. 3 to achieve the advantages described above.

FIG. 7 is a flowchart showing the control processes performed by the controller 32. As shown in FIG. 7, in step S1, the controller 32 receives a fixing job. In step S2, the controller 32 starts fixing rotation of the fixing belt 21. In step S3, the controller 32 turns on the heater 23 to heat the fixing belt 21.

In step S4, the controller 32 controls the heat shield driver 33 to move the heat shield 29 to the increased shield span position (e.g., the first position shown in FIG. 5B, the second position shown in FIG. 5C, or the third position shown in FIG. 5D) where the heat shield 29 shields the fixing belt 21 from the heater 23 in the increased axial shield span of the fixing belt 21. In step S5, the fixing belt 21 conveys a recording medium S through the fixing nip N while heating the recording medium S. In step S6, when the recording medium S is discharged from the fixing nip N, the controller 32 turns off the heater 23. In step S7, the controller 32 starts supplemental rotation of the fixing belt 21. In step S8, the controller 32 controls the heat shield driver 33 to move the heat shield 29 to the decreased shield span position (e.g., the home position shown in FIG. 5A) where the heat shield 29 shields the fixing belt 21 from the heater 23 in the decreased axial shield span of the fixing belt 21.

The above describes the control processes performed by the controller 32 incorporated in the fixing device 10. Alternatively, the controller 32 may be incorporated in the image forming apparatus 1 to control operations of the image forming apparatus 1. In this case, the controller 32 may control operations of the fixing device 10 partly or entirely. If the controller 32 controls operations of the fixing device 10 entirely, the controller 32 may be located outside the fixing device 10.

As shown in FIG. 2, the fixing device 10 includes the fixing belt 21 serving as a fixing rotator rotatable in the rotation direction B2 to fix a toner image on a recording medium S under heat; the heater 23 to heat the fixing belt 21; the nip formation pad 24 disposed opposite the inner circumferential surface of the fixing belt 21; the pressure roller 22 serving as a pressing rotator pressed against the nip formation pad 24 via the fixing belt 21 to form the fixing nip N between the fixing belt 21 and the pressure roller 22 through which the recording medium S bearing the toner image is conveyed; and the heat shield 29 interposed between the heater 23 and the fixing belt 21 and movable in the circumferential direction of the fixing belt 21 to shield the fixing belt 21 from the heater 23 in a variable axial shield span of the fixing belt 21.

As shown in FIG. 3, the fixing device 10 further includes the controller 32 operatively connected to the fixing belt 21, the heater 23, and the heat shield 29. The fixing belt 21 performs fixing rotation to convey the recording medium S through the fixing nip N while heating the recording medium S and supplemental rotation other than fixing rotation. As shown in FIG. 5A, during supplemental rotation of the fixing belt 21, the controller 32 moves the heat shield 29 to the decreased shield span position where the heat shield 29 shields the fixing belt 21 from the heater 23 in the decreased axial shield span of the fixing belt 21.

Accordingly, after the fixing belt 21 finishes heating the recording medium S conveyed through the fixing nip N, residual heat from the heater 23 is used to heat the fixing belt 21 effectively for the next fixing job, saving energy and fixing the toner image on the recording medium S properly.

As shown in FIG. 6, the heat shield 29 has the small axial shield span S1, the medium axial shield span S2, and the great axial shield span S3 disposed at each lateral end of the heat shield 29 in the longitudinal direction thereof. Alternatively, the small axial shield span S1, the medium axial shield span S2, and the great axial shield span S3 may be disposed at one lateral end of the heat shield 29 in the longitudinal direction thereof. In this case, the recording medium S is conveyed over the fixing belt 21 along one lateral edge of the fixing belt 21 in the axial direction thereof and the small axial shield span S1, the medium axial shield span S2, and the great axial shield span S3 of the heat shield 29 are disposed in proximity to another lateral edge of the fixing belt 21 in the axial direction thereof.

According to the exemplary embodiments described above, the fixing belt 21 serves as a fixing rotator. Alternatively, a fixing roller or the like may be used as a fixing rotator. Further, the pressure roller 22 serves as a pressing rotator. Alternatively, a pressure belt or the like may be used as a pressing rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation to fix a toner image on a recording medium under heat;

a heater disposed opposite the fixing rotator to heat the fixing rotator;

a pressing rotator pressed against the fixing rotator to form a fixing nip therebetween, the fixing nip through which the recording medium bearing the toner image is conveyed; and a heat shield interposed between the heater and the fixing rotator and movable in a circumferential direction of the fixing rotator to shield the fixing rotator from the heater in a variable axial shield span of the fixing rotator, wherein the fixing rotator performs fixing rotation to convey the recording medium through the fixing nip while heating the recording medium and supplemental rotation other than fixing rotation, and wherein the heat shield moves to a decreased shield span position where the heat shield shields the fixing rotator from the heater in a decreased axial shield span of the fixing rotator during supplemental rotation thereof.

2. The fixing device according to claim 1, further comprising a controller operatively connected to the fixing rotator, the heater, and the heat shield, the controller to control the fixing rotator to perform fixing rotation and supplemental rotation and to control the heat shield to move to the decreased shield span position during supplemental rotation of the fixing rotator.

3. The fixing device according to claim 2, wherein the controller controls the heat shield to move to a position other than the decreased shield span position before the fixing rotator starts supplemental rotation and move to the decreased shield span position after the fixing rotator starts supplemental rotation.

4. The fixing device according to claim 2, further comprising a nip formation pad pressing against the pressing rotator via the fixing rotator, wherein the heat shield is spaced apart from the nip formation pad with a decreased interval therebetween in the circumferential direction of the fixing rotator when the heat shield is at the decreased shield span position.

5. The fixing device according to claim 4, further comprising a temperature sensor operatively connected to the controller and disposed opposite the fixing rotator to detect a temperature of the fixing rotator, wherein the controller moves the heat shield to decrease the interval between the heat shield and the nip formation pad according to the temperature of the fixing rotator detected by the temperature sensor.

6. The fixing device according to claim 2, further comprising a nip formation pad pressing against the pressing rotator via the fixing rotator, wherein the heat shield contacts the nip formation pad when the heat shield is at the decreased shield span position.

7. The fixing device according to claim 6, further comprising a temperature sensor operatively connected to the controller and disposed opposite the fixing rotator to detect a temperature of the fixing rotator, wherein the controller brings the heat shield into contact with the nip formation pad according to the temperature of the fixing rotator detected by the temperature sensor.

8. The fixing device according to claim 1, wherein the fixing rotator includes a fixing belt.

9. The fixing device according to claim 1, wherein the pressing rotator includes a pressure roller.

10. An image forming apparatus comprising:

an image forming device to form a toner image;

a fixing device to fix the toner image on a recording medium, the fixing device including:

a fixing rotator rotatable in a predetermined direction of rotation to fix the toner image on the recording medium under heat;

a heater disposed opposite the fixing rotator to heat the fixing rotator;

a pressing rotator pressed against the fixing rotator to form a fixing nip therebetween, the fixing nip through which the recording medium bearing the toner image is conveyed; and a heat shield interposed between the heater and the fixing rotator and movable in a circumferential direction of the fixing rotator to shield the fixing rotator from the heater in a variable axial shield span of the fixing rotator; and a controller operatively connected to the fixing rotator, the heater, and the heat shield, the controller to control the fixing rotator to perform fixing rotation to convey the recording medium through the fixing nip while heating the recording medium and supplemental rotation other than fixing rotation and to control the heat shield to move to a decreased shield span position where the heat shield shields the fixing rotator from the heater in a decreased axial shield span of the fixing rotator during supplemental rotation thereof.

11. A fixing method comprising:

receiving a fixing job;

starting fixing rotation of a fixing rotator;

turning on a heater to heat the fixing rotator;

moving a heat shield to an increased shield span position where the heat shield shields the fixing rotator from the heater in an increased axial shield span of the fixing rotator;

conveying a recording medium over the fixing rotator;

turning off the heater;

starting supplemental rotation of the fixing rotator; and moving the heat shield to a decreased shield span position where the heat shield shields the fixing rotator from the heater in a decreased axial shield span of the fixing rotator.

* * * * *